United States Patent [19]

Aoki et al.

[11] Patent Number: 4,644,760

[45] Date of Patent: Feb. 24, 1987

[54] REVERSIBLE FOUR-WAY VALVE FOR REVERSIBLE REFRIGERATING CYCLE

[75] Inventors: Tadashi Aoki; Masakazu Isobe; Hiroshi Kuno, all of Tokyo, Japan

[73] Assignee: Kabushiki Kaisha Saginomiya Seisakusho, Japan

[21] Appl. No.: 794,851

[22] Filed: Nov. 4, 1985

[30] Foreign Application Priority Data

| | | | |
|---|---|---|---|
| Nov. 5, 1984 | [JP] | Japan | 59-232932 |
| Mar. 13, 1985 | [JP] | Japan | 60-048122 |
| Mar. 25, 1985 | [JP] | Japan | 60-058290 |
| Apr. 12, 1985 | [JP] | Japan | 60-076629 |
| Oct. 21, 1985 | [JP] | Japan | 60-233175 |

[51] Int. Cl.[4] ..... F25B 13/00

[52] U.S. Cl. ..... 62/324.6; 137/625.43

[58] Field of Search ..... 62/324.1, 324.6; 137/625.29, 625.66, 625.43, 625.65

[56] References Cited

U.S. PATENT DOCUMENTS

| | | | |
|---|---|---|---|
| 2,983,286 | 5/1961 | Greenawalt et al. | 137/625.43 |
| 3,032,312 | 5/1962 | Greenawalt | 62/324.6 X |
| 3,867,960 | 2/1975 | Hosoda et al. | 137/625.43 X |
| 3,952,537 | 4/1976 | Aoki et al. | 62/324.6 |
| 4,112,974 | 9/1978 | Davis et al. | 62/324.6 X |
| 4,212,324 | 7/1980 | Bauer | 137/625.66 |
| 4,318,425 | 3/1982 | Marks | 62/324.6 X |
| 4,324,273 | 4/1982 | Bauer et al. | 62/324.6 X |

*Primary Examiner*—Lloyd L. King

*Attorney, Agent, or Firm*—Lowe, Price, LeBlanc, Becker & Shur

[57] ABSTRACT

Reversible four-way valve for the refrigerating system. It has a cylindrical valve body through which a single piston is adapted to reciprocate slidably. This single piston divides the cylindrical valve body into two chambers. One of the two chambers is used for admitting high pressure gas thereinto whereas the other is assigned for controlling the piston in counteracting the high pressure gas. For this purpose, the piston is formed with a pressure equalizing hole therein to communicate the two chambers with each other while the piston is urged toward the chamber into which the high pressure is admitted. This is done by a compression spring having a force stronger than required to overcome all resistance when both chambers are under the equal pressure. Since the reversible valve has only two chambers, compact design is possible and the operation is stable.

8 Claims, 14 Drawing Figures

REVERSIBLE FOUR-WAY VALVE FOR REVERSIBLE REFRIGERATING CYCLE

BACKGROUND OF THE INVENTION

The present invention relates to a reversible four-way valve used in a cooler/heater type air conditioner for switchover operation between an indoor cooling mode and an indoor heating mode.

The conventional pressure differential drive type reversible four-way valve includes a cylindrical valve body, a pair of pistons provided therein to divide said valve body for the most part into three chambers such as a high pressure chamber, a low pressure chamber and a pressure control chamber or a combination of a high pressure chamber and two pressure control chambers. In such conventional four-way valve, pressure in said pressure control chamber is reversibly controlled by a three-way electro-magnetic pilot valve to operate the pistons and the selector valve connected thereto.

The above prior art has a drawback that the structures of the reversible valve body and the pilot body are complicated, involving numerous communication conduits that forestall miniturization. Another drawback includes that the control by means of the electromagnetic pilot valve is intended for the negative decompression and positive compression of the pressure control chamber which is not suited for a delicate electromagnetic control.

The inventor took, the above mentioned drawbacks into consideration to come up with an idea of dividing the valve body by a single piston into two chambers including a high pressure chamber and a pressure control chamber while controlling the pressure control chamber by a pilot valve to move the piston and the slide valve connected thereto. As a result, simplification and miniturization of the structure has been attained while enabling a delicate electromagnetic control. Moreover, delicate electromagnetic control by means of sensitive electromagnetic means can now be used because the control of the pressure control chamber is performed by controlling a one-way refrigerant flow from the pressure control chamber to the compresser.

SUMMARY OF THE INVENTION

According to the present invention, there is essentially provided a reversible four-way valve for reversible refrigerating cycle comprising a cylindrical reversible valve body; a single piston slidably provided within said cylindrical reversible valve body to divide the same into a first chamber and a second chamber, said first chamber being formed with a high pressure port communicating with a compressor delivery side, said single piston having an equalizing hole therein to render said first and second chambers in communication with each other; a valve seat formed within said first chamber to extend longitudinally, said valve seat being formed with a first outlet communicating with a first heat exchanger and a second outlet communicating with a second heat exchanger, said valve seat being formed with a low pressure port between said first and second outlets for communicating with a compresser suction side; a slide valve connected to said single piston and adapted to slide over said valve seat to communicate said low pressure port selectively with said first outlet and said second outlet; resilient means having a force stronger than required to urge said piston toward the first chamber when both chambers are under an equal pressure; bleeder or low pressure communication means for bringing said second chamber and said compressor suction side into communication with each other, said bleeder means having a larger diameter than said pressure equalizing hole in the single piston; and pilot valve means for controlling said bleeder means for selectively closing and opening said bleeder means.

DETAILED DESCRIPTION OF THE EMBODIMENTS

Figure 1:
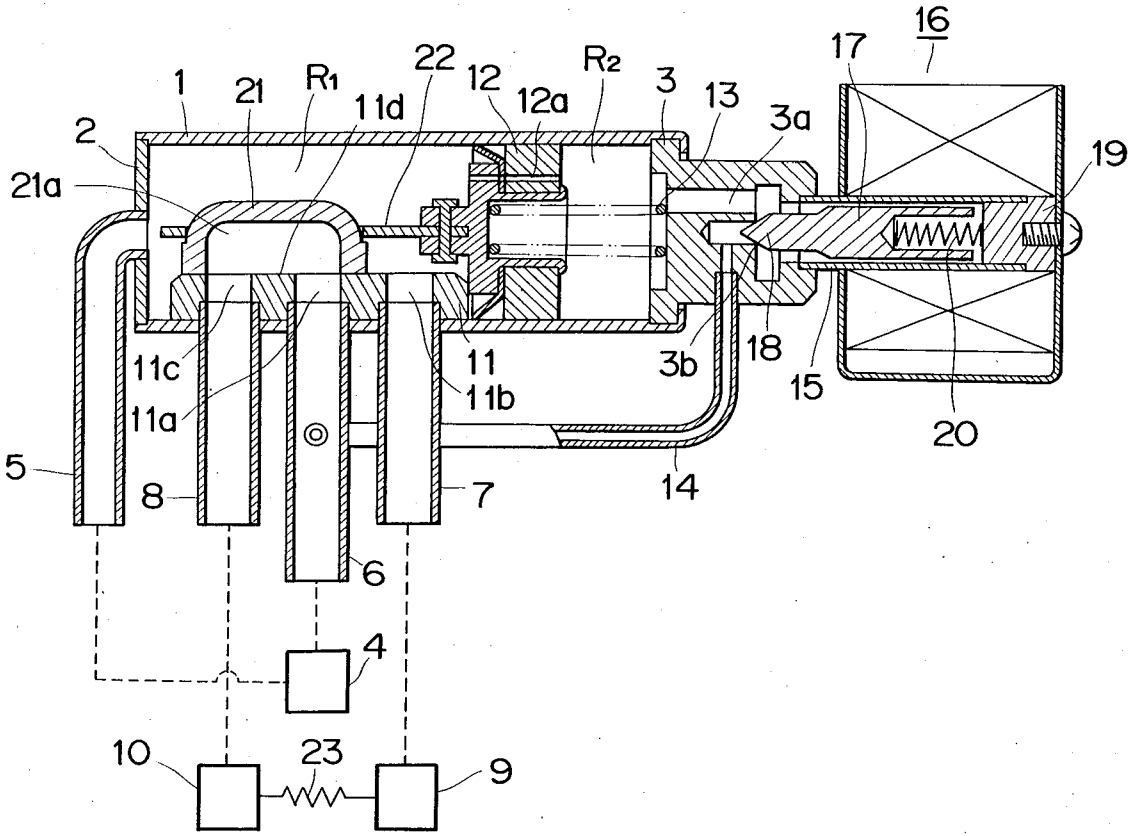
FIG. 1 is a longitudinal sectional view of one embodiment of the present invention in which the piston takes a first position.

The first embodiment of the present invention will be explained referring to FIG. 1. Cylindrical reversible valve body 1 is welded with plug members 2 and 3 at longitudinal ends thereof. Said plug member 2 is formed with a high pressure port which is connected to delivery tube 5 communicating with rotary compresser 4.

Within said cylindrical valve body 1 is provided a single piston 12 slidably to divide the valve body into high pressure chamber $R_1$ and pressure control chamber $R_2$ which will be referred to hereinafter as a first chamber $R_1$ and a second chamber $R_2$. Said high pressure port is provided to open into the first chamber $R_1$. Further, said single piston 12 has a pressure equalizing hole 12*a* therein to render said first and second chambers $R_1$ and $R_2$ in communication with each other.

Metal valve seat 11 is formed within the first chamber $R_1$ to extend longitudinally therein and has a flat slide surface. Said valve seat 11 is formed with a first outlet 11*b* and a second outlet 11*c*. Conduit 7 opens into said first outlet 11*b* at one end thereof and communicates with first heat exchanger 9 at another end thereof. On the other hand, conduit 8 opens into said second outlet 11*c* at one end thereof and communicates with second heat exchanger 10 at another end thereof. Between said first and second outlets 11*b* and 11*c*, there is formed a low pressure port 11*a* in the valve seat 11. Said low pressure port 11*a* communicates with suction tube 6 connected to rotary compressor 4.

Compression spring 13 is provided in second chamber $R_2$ between plug member 3 and piston 12 to urge the same toward first chamber $R_1$. Said spring 13 has a force stronger than required to urge the piston 12 toward the first chamber $R_1$ when said first and second chambers are under an equal pressure. Bleeder hole 3*a* is formed in plug member 3. Said bleeder hole 3*a* opens into second chamber $R_2$ at one end thereof and communicates with suction tube 6 via conduit 14 at the other end thereof. Said bleeder hole 3*a* has a larger diameter than pressure equalizing hole 12*a*.

Electromagnetic pilot valve 16 is attached to said plug member 3 via plunger tube 15. Said plunger tube 15 guides plunger 17 therethrough such that the tip of the needle valve 18 integrally formed in said plunger 17 opens or closes valve seat 3*b* formed in bleeder hole 3*a*. Compression spring 20 is provided between plunger 17 and iron core 19 to urge needle valve 18 to close valve seat 3*b* when the pilot valve 16 is deenergized.

Slide valve 21 which is made of ethylene tetrafluoride (Teflon) is coupled by piston rod 22 to piston 12. Said slide valve 21 is designed to slide over valve seat 11. Said slide valve 21 defines communication selecting room 21*a* in cooperation with valve seat 11 which functions to communicate low suction tube 6 selectively with conduit 7 and conduit 8 connected to heat exchangers 9 and 10, respectively.

Referring to FIG. 1, the four-way valve is positioned for enabling the cooling operation of the air conditioner. As no electric current is supplied to electromagnetic pilot valve 16, spring 20 maintains plunger 17 in its position in which needle valve 18 closes bleeder hole 3*a*. The pressures in chambers $R_1$ and $R_2$ are equalized as a result of the flow of fluid through hole 12*a*, and piston 12 is moved by spring 13 until it takes a first position as depicted in FIG. 1. Therefore, slide valve 21 establishes fluid communication between low pressure outlet 11*a* and second port 11*c*, and the cooling medium leaving compressor 4 flows through delivering tube 5, conduit 7, outdoor heat exchanger 9, throttle 23, indoor heat exchanger 10, conduit 8 and suction tube 6 and returns into compressor 4, thus performing an indoor cooling operation.

Figure 2:
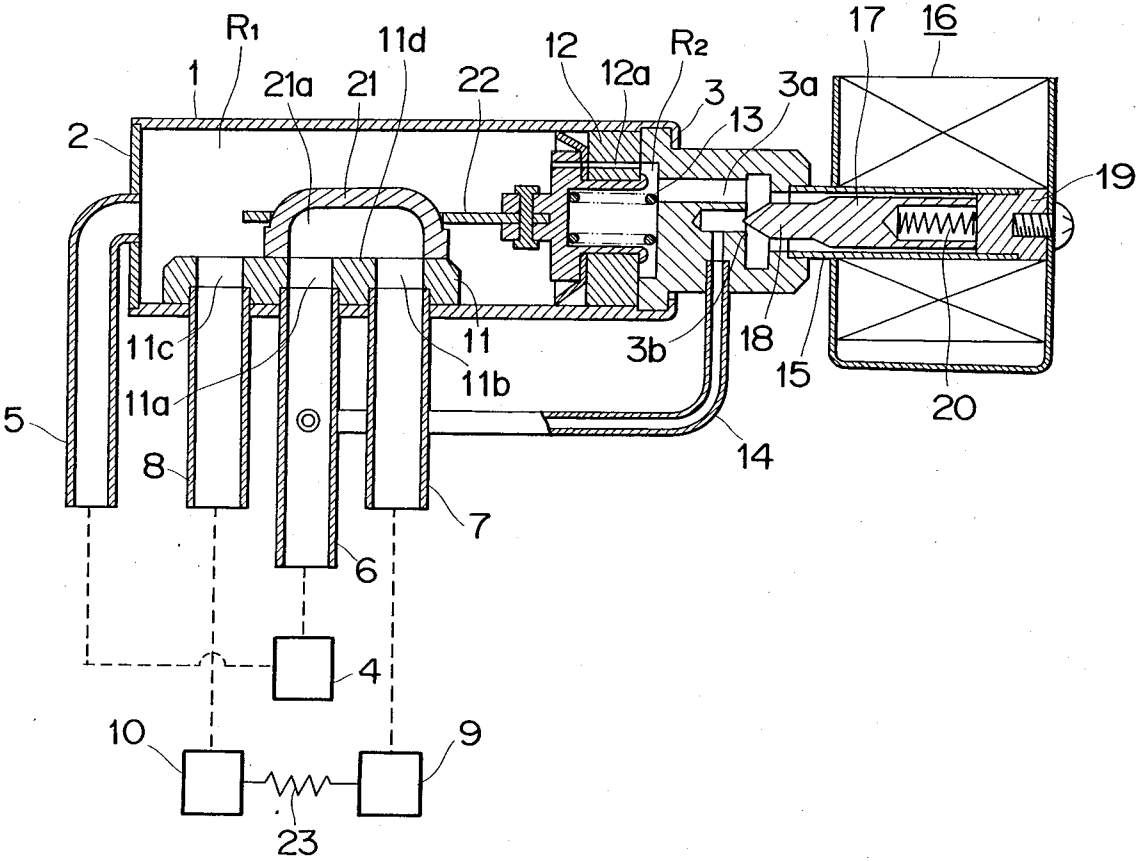
FIG. 2 is a similar view of the embodiment of FIG. 1, in which the piston takes a second position.

Attention is now directed to FIG. 2 showing the four-way valve positioned for enabling the indoor heating operation of the air conditioner. If an electric current is supplied to electro-magnetic pilot valve 16 simultaneously when compressor 4 is started, plunger 17 is magnetically attracted by iron core 19 and needle valve 18 leaves the valve seat 3*b* to thereby open bleeder hole 3*a*, whereby second chamber $R_2$ is connected with suction tube 6 of compressor 4 in which negative pressure prevails. Accordingly, the cooling medium flows from second chamber $R_2$ into suction tube 6 through bleeder hole 3*a* and conduit 14, and also from first chamber $R_1$ to second chamber $R_2$ through pressure equalizing hole 12*a*. As bleeder tube 3*a* has a larger diameter than pressure equalizing hole 12*a*, however, the amount of the cooling medium flowing out of second chamber $R_2$ is greater than the amount of the fluid flowing there-into. A negative pressure is, therefore, created in second chamber $R_2$ and piston 12 and slide valve 21 are moved toward plug member 3 by overcoming the force of spring 13 until they take the second position as depicted in FIG. 2. Slide valve 21 establishes fluid communication between low pressure port 11*a* and second outlet 11*b*, and the cooling medium leaving compressor 4 flows through delivery tube 5, conduit 8, indoor heat exchanger 10, throttle 23, outdoor heat exchanger 9, conduit 7 and suction tube 6 before returning into the compressor 4, thus performing an indoor heating operation.

If compressor 4 is stopped by a thermostat during the heating operation of the air conditioner, a gradual equalization of pressure takes place between the two chambers. If their difference in pressure is reduced to a predetermined level, piston 12 is urged back by spring 13 to place slide valve 21 into the first position, enabling the indoor cooling operation of the air conditioner.

Figures 3, 4:
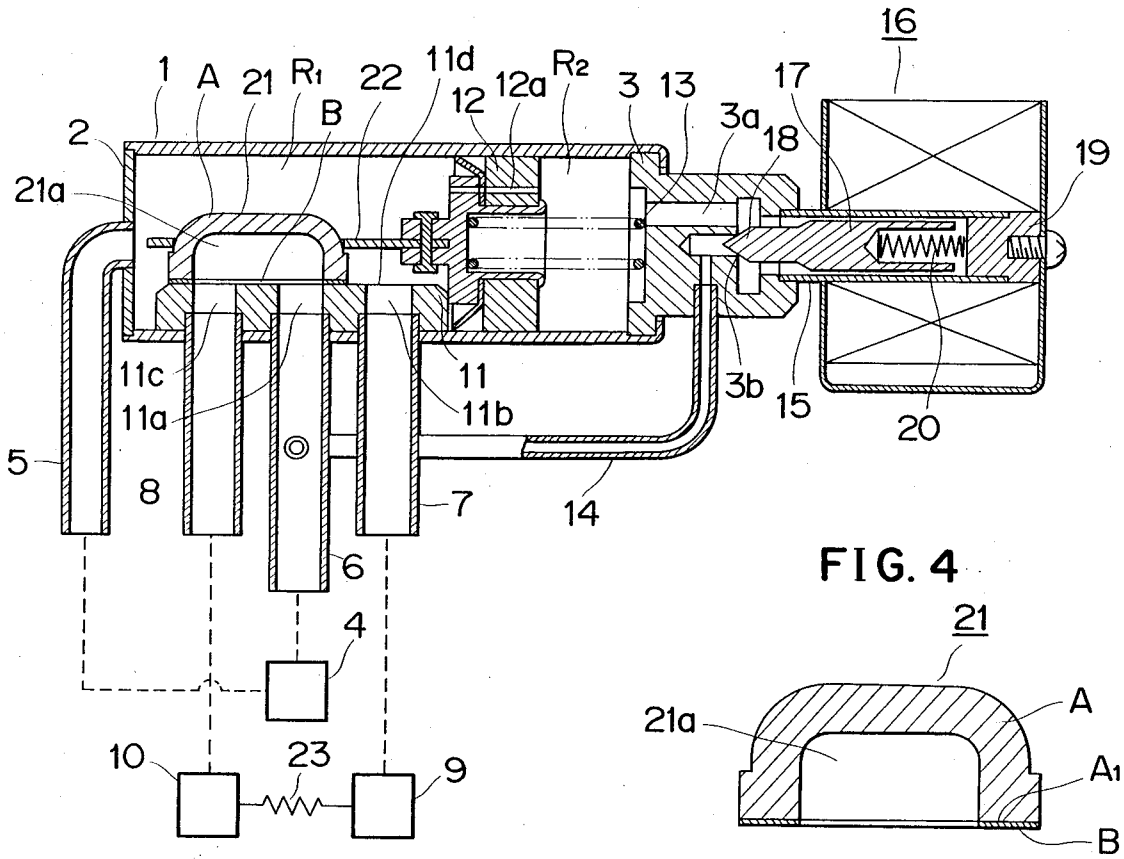
FIG. 3 is a longitudinal sectional view of another embodiment in which the piston takes the first position.
FIG. 4 is a lateral sectional view of the slide valve used in the embodiment of FIG. 3.
Figure 5:
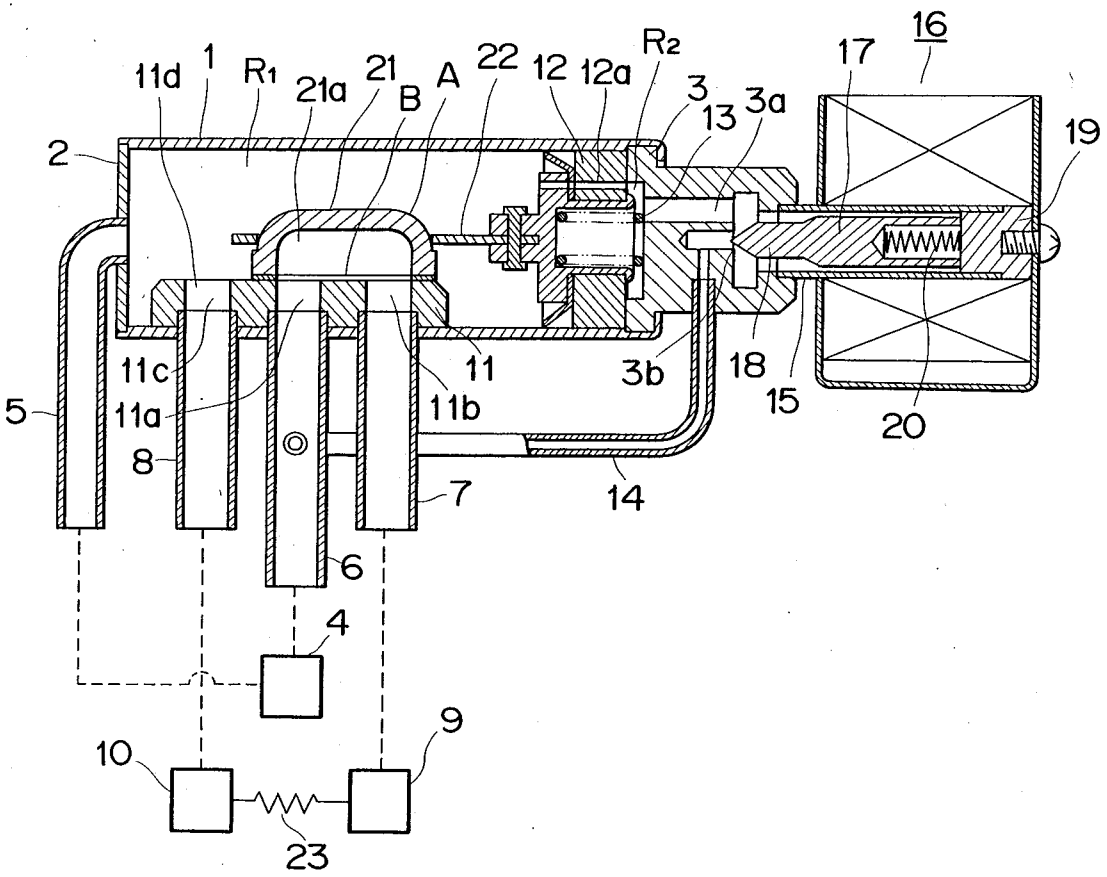
FIG. 5 is a similar view of FIG. 3, in which the piston takes the second position.

Referring to FIGS. 3 through 5, there is shown another embodiment of the present invention. The valve comprises cylindrical valve body 1 having a pair of ends to which end plug members 2 and 3 are respectively welded. Delivery tube 5 of compressor 4 is connected to plug member 2 at one end of valve body 1. Suction tube 6 of compressor 4 is connected to valve body 1 at right angles to its sidewall. Two conduits 7 and 8 are also connected to the sidewall of of valve body 1 and lie on the opposite side of suction tube 6 from each other. Conduits 7 and 8 are also connected to two heat exchangers 9 and 10, respectively, which are each reversibly operable as a condenser or an evaporator. Valve seat 11 is provided in the inner surface of the sidewall of valve body 1 and has low pressure port 11*a*, first outlet 11*b* and second outlet 11*c* to which the inner ends of suction tube 6 and the conduits 7 and 8 are respectively connected. Valve seat 11 has a smooth inner surface 11*d*.

Piston 12 is slidably disposed in the valve body 1 between end plug member 3 and valve seat 11. Piston 12 divides the interior of the casing 1 into first chamber $R_1$ and second chamber $R_2$. Compression spring 13 is provided between plug member 3 and piston 12 for urging piston 12 toward said first chamber $R_1$. Piston 12 has pressure equalizing port 12*a* by which first chamber $R_1$ is normally connected to second chamber $R_2$. Plug member 3 is provided with bleeder hole 3*a* having a diameter which is larger than that of pressure equalizing port 12*a*. Conduit 14 extends from bleeder hole 3*a* to suction tube 6.

An electromagnetic pilot valve 16 includes plunger tube 15 having one end connected to plug member 3. Needle valve 18 is integrally provided in plunger 17 and has a pointed end projecting from plunger guide 15. Plug member 3 has a valve seat 3*b*. Plunger 17 is axially movable so that needle valve 18 may rest on valve seat 3*b* to close the bleeder hole 3*a*. Iron core 19 is secured to the other end of the plunger guide 15. Compression spring 20 is provided between plunger 17 and iron core 19 for urging needle valve 18 to stay in its position in which it rests on valve seat 3*b*.

Inverted cup-shaped slide valve 21 is provided on valve seat 11 and has communication selecting room 21*a*. Slide valve 21 is connected to piston 12 by piston rod 22. Slide valve 21 is movable by piston 12 so that communication selecting room 21*a* may establish the selective fluid communication of low pressure port 11*a* in valve seat 11 with first and second outlets 11*b* and 11*c*. The slide valve 21 comprises an inverted cup-shaped main body A formed from a polymeric material, such as nylon or Teflon, and metal film B formed on the lower end surface $A_1$ of the main body A, as shown in FIG. 4. Metal film B may, for example, be formed of titanium, chromium, copper or tin, or an Fe-Cr-Al alloy by vacuum evaporation, sputtering or plating. Metal film B preferably has a thickness not exceeding three microns, If it has a greater thickness it is likely to fail to form a flat and smooth surface snugly fitting lower end surface $A_1$ of main body A.

As depicted in FIG. 3, the four-way valve is in the first position for indoor cooling of the air conditioner. As no electric current is supplied to electromagnetic pilot valve 16, spring 20 maintains plunger 17 in its position in which needle valve 18 closes bleeder hole 3*a*. The pressures of chambers $R_1$ and $R_2$ are equalized as a result of the flow of fluid through hole 12*a*, and piston 12 is moved by spring 13 until it abuts on valve seat 11. Therefore, slide valve 21 made of ethylene tetrafluoride establishes fluid communication between low pressure outlet 11*a* and second port 11*c*, and the cooling medium leaving compressor 4 flows through delivery tube 5, conduit 7, outdoor heat exchanger 9, throttle 23, indoor heat exchanger 10, conduit 8 and suction tube 6 and returns into compressor 4, thus performing an indoor cooling operation.

Attention is now directed to FIG. 5 showing the four-way valve positioned for enabling the heating operation of the air conditioner as will hereunder be described. If an electric current is supplied to electromagnetic pilot valve 16 simultaneously when compressor 4 is started, plunger 17 is magnetically attracted by iron core 19 and needle valve 18 leaves the valve seat 3*b* to thereby open bleeder hole 3*a*, whereby second chamber $R_2$ is connected with suction tube 6 of compressor 4 in which negative pressure prevails. Accordingly, the cooling medium flows from second chamber $R_2$ into suction tube 6 through bleeder hole 3*a* and conduit 14, and also from first chamber $R_1$ to second chamber $R_2$ through pressure equalizing hole 12*a*. As bleeder tube 3*a* has a larger diameter than pressure equalizing hole 12*a*, however, the amount of the cooling medium flowing out of second chamber $R_2$ is greater than the amount of the fluid flowing thereinto. A negative pressure is, therefore, created in second chamber $R_2$ and piston 12 and slide valve 21 are moved toward plug member 3 by overcoming the force of spring 13. Slide valve member 21 establishes fluid communication between low pressure port 11*a* and second outlet 11*b*, and the cooling medium leaving compressor 4 flows through delivery tube 5, conduit 8, indoor heat exchanger 10, throttle 23, outdoor heat exchanger 9, conduit 7 and suction tube 6 before returning into the compressor 4, thus performing an indoor heating operation.

If compressor 4 is stopped by a thermostat during the heating operation of the air conditioner, a gradual equalization of pressure takes place between the two chambers. If their difference in pressure is reduced to a predetermined level, piston 12 is urged back by spring 13 to place slide valve 21 into the first position enabling the cooling operation of the air conditioner.

The operation of the second embodiment is substantially the same as the first embodiment. In this embodiment, however, the contacting surfaces of slide valve 21 and valve seat 11 are both metallic and have substantially the same coefficient of friction. Therefore, valve member 21 is smoothly and reliably movable whenever required for switching the operation of the air conditioner.

Figure 6:
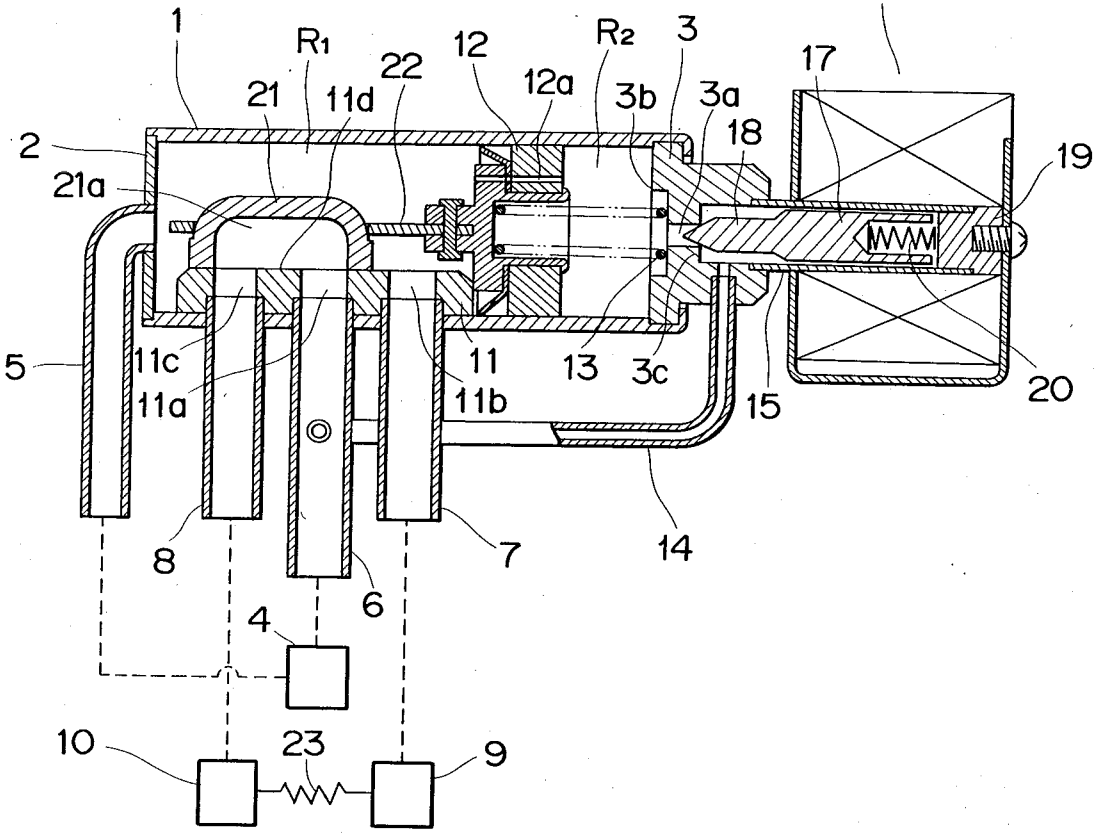
FIG. 6 is a longitudinal sectional view of a further embodiment in which the piston takes the first position.
Figure 7:
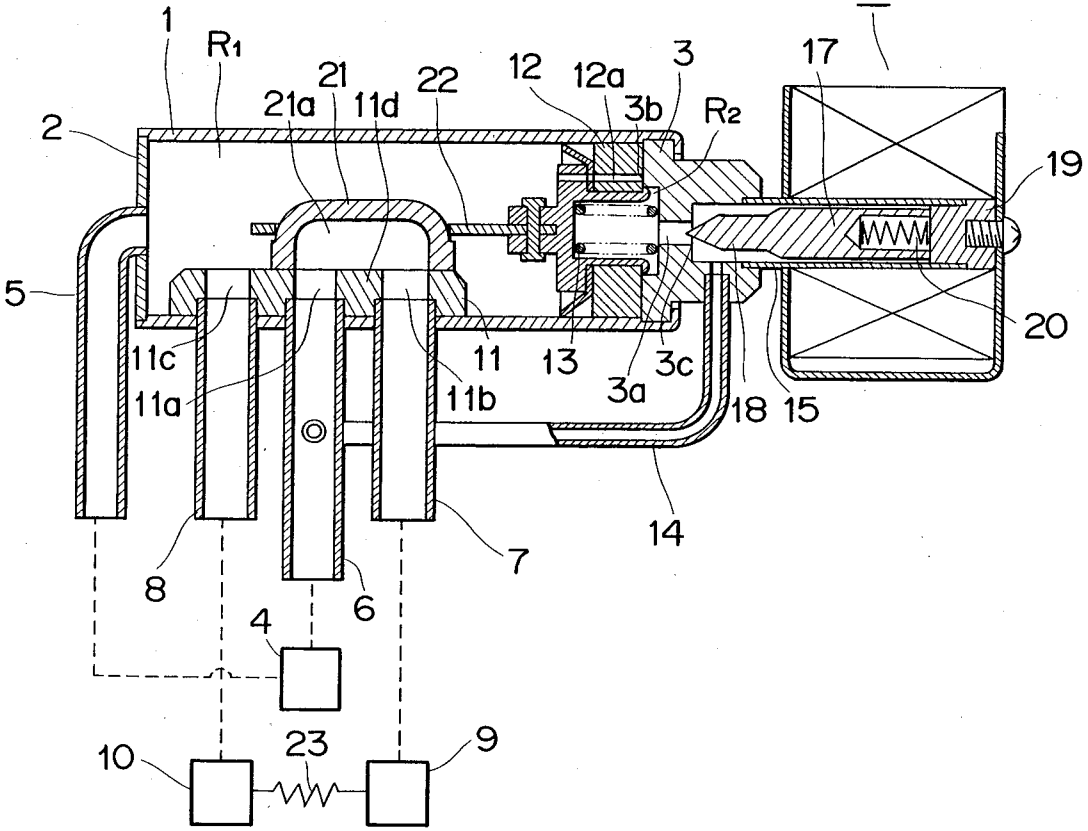
FIG. 7 is a similar view of the embodiment of FIG. 7 in which the piston takes the second position.

Referring to FIGS. 6 and 7, there is shown a third embodiment of the invention. The structure thereof is substantially the same as the first embodiment except that plug member 3 has means for blocking pressure equalizing hole 12*a* in the form of inner block wall 3*b* of the plug member 3. In other words, said inner block wall 3*b* faces said pressure equalizing hole 12*a* at the longitudinal end of the cylinder body 1 on the second chamber side. Therefore, said pressure equalizing hole 12*a* stays opened when piston 12 and slide valve 21 take the first position as depicted in FIG. 6. On the other hand, said hole 12*a* is blocked by inner block wall 3*b* when piston 2 and slide valve 21 take the second position as depicted in FIG. 7. As a result, the room heating operation is well maintained without energy loss even if the pilot valve 16 is maintained energized such that needle valve 18 retreats to open bleeder hole 3*a*. For switching the indoor heating operation into indoor cooling operation, a thermostat provided in the refrigerating cycle operates to stop compressor 4 such that compression spring 13 urges piston 12 overcoming pressure reduced in the first chamber, thus shifting the refrigerating cycle from the indoor heating operation to indoor cooling operation.

Figure 8:
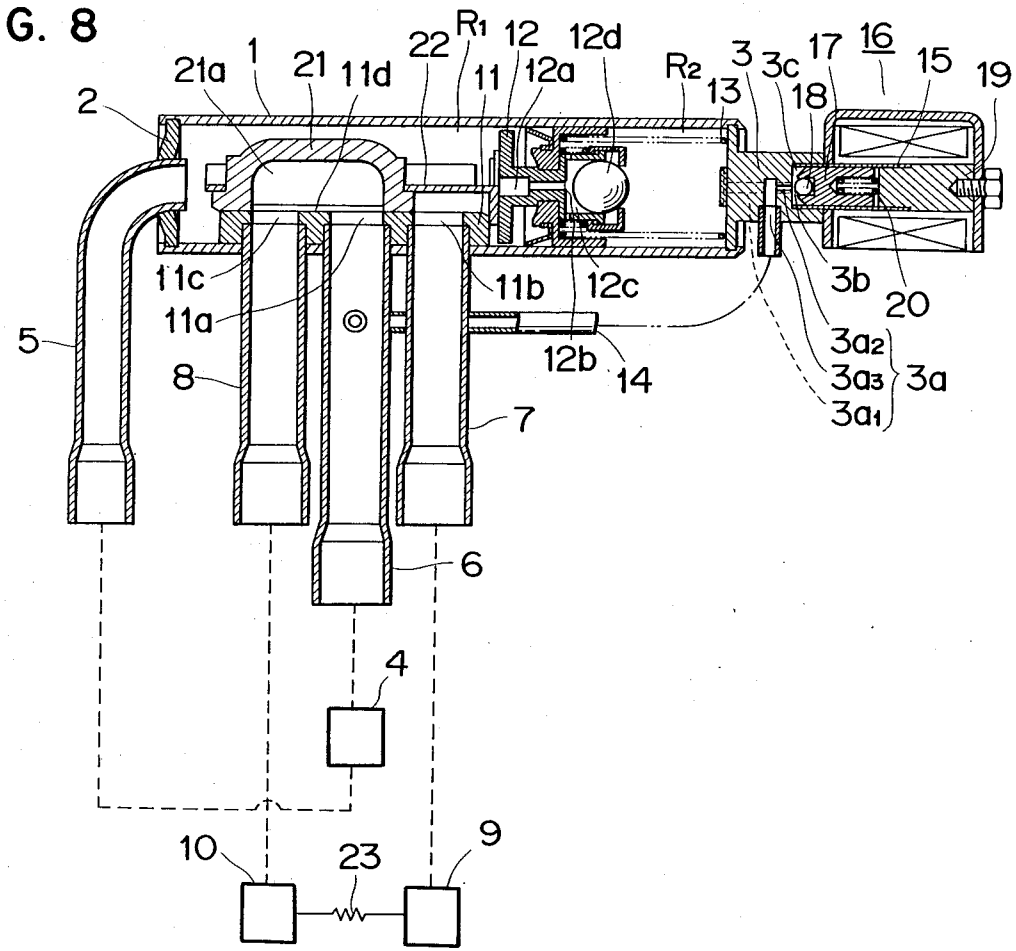
FIG. 8 is a longitudinal sectional view of a still further embodiment of the invention.

Referring to FIGS. 8 through 11, a fourth embodiment of the present invention will be explained. The general structure thereof is substantially the same as the third embodiment except for the equalizing hole blocking means. As shown in FIG. 8 valve seat 12*b* is formed around that end of pressure equalizing port 12*a* which faces pressure control chamber $R_2$. Cylindrical wall 12*e* is provided behind piston 12 and extends toward plug member 3. The wall 12*e* defines therein valve chamber 12*c* in which a ball defining valve member 12*d* is located. Abutment ring 12*f* is slidably fitted about the wall 12*e* and has opening 12*f* through which valve member 12*d* partly projects outwardly of valve chamber 12*c*. Compression spring 12*g*, which is an auxiliary return spring, surrounds wall 12*e* between piston 12 and ring 12*f* and urges ring 12*f* toward plug member 3.

Electromagnetic valve 16 includes tubular plunger housing 15 having one end connected to plug member 3. Ball valve member 18 is provided on plunger 17 and has a pointed end projecting from plunger guide 15. Plug member 3 has valve seat 3*b*. Plunger 17 is axially movable so that ball valve member 18 may rest on the valve seat 3*b* to close bleeder hole 3*a*. Bleeder hole is formed by hole 3*a*, extending from pressure control chamber $R_2$ to valve chamber 3*c* adjacent to the outer periphery of plug member 3, hole $3a_2$ extending from valve chamber 3*c* to the center of the plug member 3 and hole $3a_3$ extending radially from hole $3a_2$. Valve seat 3*b* is formed around that end of hole $3a_2$ which faces valve chamber 3*c*. Conduit 14 is connected to hole $3a_3$.

Iron core 19 is secured to the other end of plunger guide 15. Compression spring 20 is provided between plunger 17 and core 19 for urging valve member 18 to stay in its position in which it rests on valve seat 3*b*.

Figure 9:
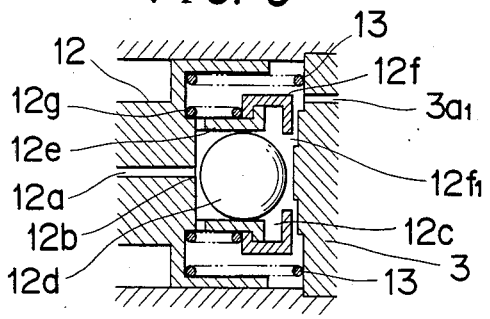
FIGS. 9 and 10 are enlarged view of the ball valve and its surrounding structure used in the embodiment of FIG. 8.

Referring to FIGS. 8 and 9, the four-way valve is taking the first position for enabling the cooling operation of the air conditioner. As no electric current is supplied to electromagnetic valve 16, spring 20 maintains plunger 17 in its position in which ball valve member 18 closes bleeder hole 3*a*. Pressures of chamber $R_1$ and $R_2$ are equalized as a result of the flow of fluid through port 12*a*, and piston 12 is moved by spring 13 until it abuts on valve seat 11. Therefore, slide valve 21 establishes the fluid communication between low pressure port 11*a* and second outlet 11*c*, and the cooling medium leaving compressor 4 flows through delivery tube 5, conduit 7, outdoor heat exchanger 9, throttle 23, indoor heat exchanger 10, conduit 8 and suction tube 6 and returns into the compressor 4, thus performing the indoor cooling operation.

Figure 10:
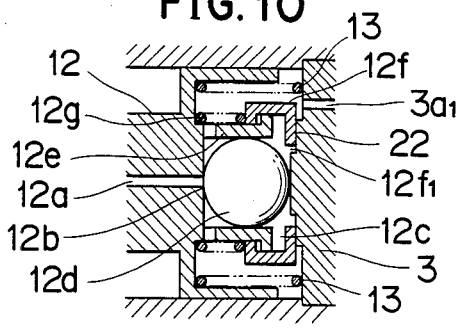
Figure 11:
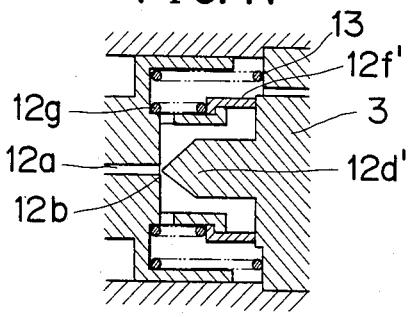
FIG. 11 is a modification of the structure shown in FIGS. 9 and 10.

Attention is now directed to FIGS. 8 and 10 showing the four-way valve positioned for enabling the heating operation of the air conditioner as will as will hereunder be described. If an electric current is supplied to electromagnetic valve 16 simultaneously when compressor 4 is started, plunger 17 is magnetically attracted by iron core 19 and ball valve member 18 leaves valve seat 3*b* to thereby open bleeder hole 3*a*, whereby the pressure control chamber $R_2$ is fluidally connected with suction tube 6 of compressor 4 in which a negative pressure prevails. Accordingly, the cooling medium flows from pressure control chamber $R_2$ into suction tube 6 through bleeder hole 3*a* and conduit 14, and also from high pressure chamber $R_1$ to pressure control chamber $R_2$ through the pressure equalizing hole 12*a*. As bleeder hole 3*a* has a larger diameter than the pressure equalizing hole 12*a*, however, the amount of the cooling medium flowing out of chamber $R_2$ is greater than the amount of the fluid flowing thereinto. A negative pressure is, therefore, created in chamber $R_2$ and piston 12 and slide vavle member 21 move toward plug member 3 by overcoming the force of spring 13.

As a result, valve member 12*d* and abutment member 12*f* abut on plug member 3. The auxiliary return spring 12*g* is compressed and valve member 12*d* is brought into contact with the valve seat 12*b* to close the pressure equalizing port 12. Slide valve 21 establishes the fluid communication between low pressure port 11*a* and first conduit and the cooling medium leaving the compressor 4 flows through delivery tube 5, conduit 8, indoor heat exchanger 10, throttle 23, outdoor heat exchanger 9, conduit 7 and suction tube 6 before returning into the compressor 4, whereby the air conditioner is placed in heating operation.

If compressor 4 is stopped by a thermostat during the heating operation of the air conditioner, a gradual equalization of pressure takes place between the high and low pressure chambers. If their difference in pressure is reduced to a predetermined level, spring 13 and auxiliary spring 12*g* urge piston 12 to start moving at a relatively high speed. The air conditioner is, thus, switched from the heating operation to the cooling operation quickly, and starts the defrosting operation upon receiving a defrosting start signal.

A modified structure is shown in FIG. 4. It includes needle valve member 12*d'* integrally formed in plug member 3 and facing the pressure equalizing hole 12*a* in piston 12. If piston 12 approaches the plug member 3, valve member 12*d'* abuts on valve seat 12*b* to close hole 12*a*. The plug member 3 is also provided with projection 12*f'* which replaces abutment member 12f hereinbefore described and enables the compression of auxiliary spring 12*g* when piston 12 has approached plug member 3.

Figure 12:
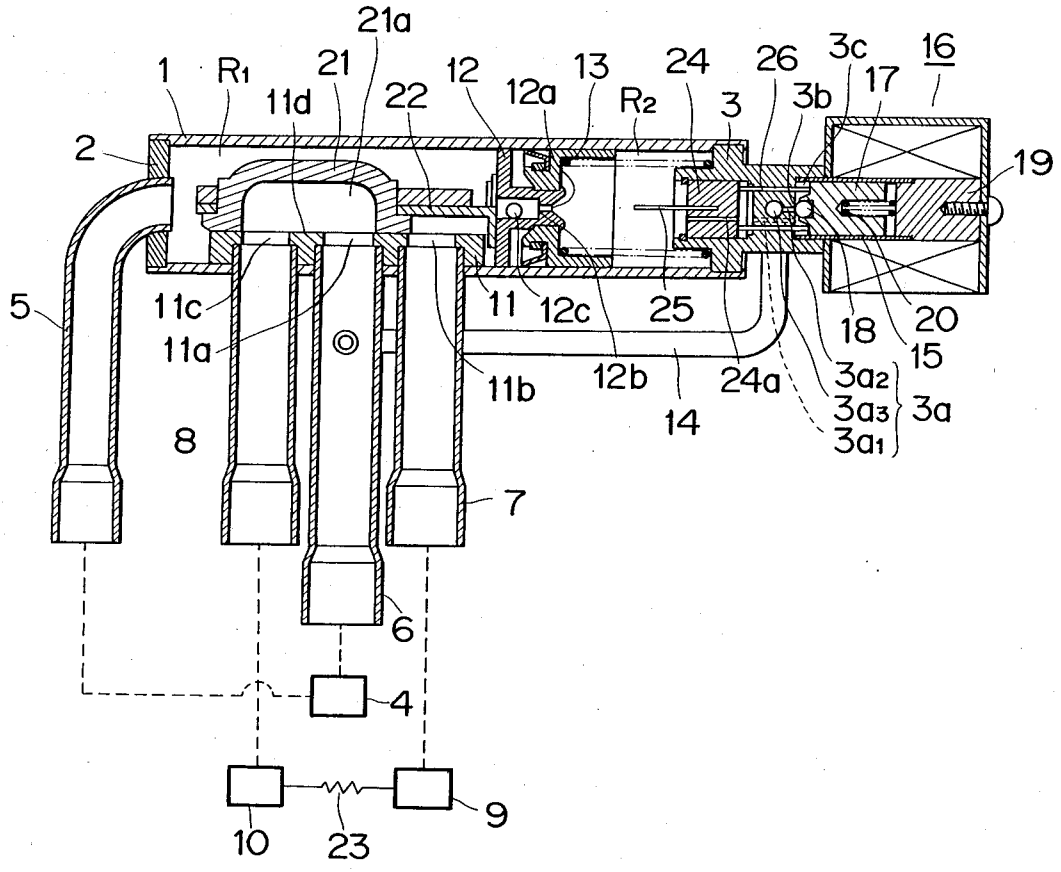
FIG. 12 is a longitudinal sectional view of a still further embodiment of the invention wherein a ball valve is provided in the first chamber to block the pressure equalizing hole.
Figure 13:
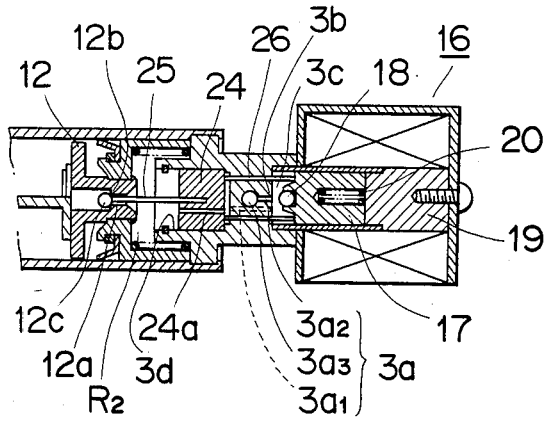
FIGS. 13 and 14 are enlarged views of the ball valve and its relating structure in the embodiment of FIG. 12.
Figure 14:
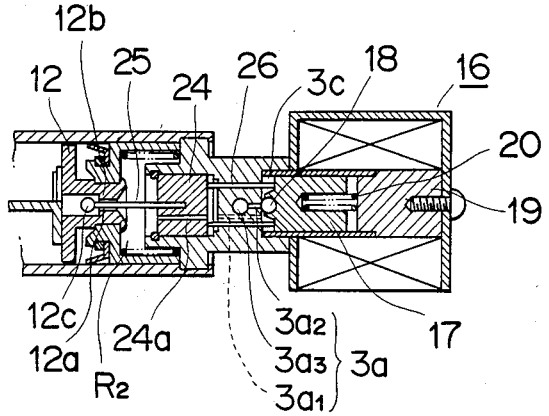

Referring to FIGS. 12 through 14, a fourth embodiment of the present invention will be explained. The general structure thereof is subtantially the same as the fourth embodiment except for the structure of the piston 12 and plug 3. As shown in FIG. 12, there is formed a recess in the first chamber side of piston 12 to receive ball valve 12*c* which is adapted to rest against valve seat 12*b*. On the other hand, bleeder hole 3*a* is formed in plug 3 to be connected to suction tube 6 via conduit 14.

Electromagnetic pilot valve 16 is attached to plug member 3 via plunger guide 15. Through said plunger guide 15 is slidably provided plunger 17 having ball valve 18 provided at a tip end thereof. Said ball valve 18 is adapted to rest against valve seat 3*b* formed in bleeder hole 3*a* to open or close said bleeder hole 3*a*. Compression spring 20 is provided between plunger 17 and iron core 19 to urge said ball valve 18 toward valve seat 3*b*.

In this embodiment, bleeder hole 3*d* consists of a radially outer section $3a_1$ leading from second chamber $R_2$ to valve chamber 3*c*, a radially inner section $3a_2$ leading from valve seat 3*b* back toward the second chamber side as far as halfway and a radially extending section $3a_3$ leading outwardly from radially inner section 3*a* to conduit 14.

Said plug 3 is formed with recess 3*d* formed in the second chamber side of plug member 3 into which slider 24 is axially slidably inserted. Said slider 24 is formed therein with throughhole 24*a* extending axially. Drive pin 25 is buried longitudinally centrally in said slider 24 to extend through said pressure equalizing hole 12*a* to push ball valve 12*c* away from valve seat 12*b* when piston 12 takes the second position. Said drive pin 25 has a diameter smaller than pressure equalizing hole 12*a*.

Through plug 3 is slidably provided coupling pin 26 in the longitudinal direction. Said coupling pin 26 transmits to slider 24 the movement of plunger 17 away from iron core 19 by virtue of compression spring 20 at the time of pilot valve 16 being deenergized.

Piston 12 and slide valve 21 take the first position for the refrigerator system to perform indoor cooling operation. If electromagnetic pilot valve 16 is energized while compressor 4 is being started, plunger 17 is attracted toward iron core 19, permitting ball valve 18 to open bleeder hole 3*a* such that second chamber $R_2$ is brought into communication with the suction side of compressor 4. In this situation, ball valve 12*c* is attracted to rest against valve seat 12*b* to close pressure equalization hole 12*a*, thus producing the pressure difference between chamber $R_1$ and chamber $R_2$ to move piston 12 and slide valve 21 toward plug 3 by overcoming the resiliency of compression spring 13. Thus, slide valve 21 causes low pressure port 11*a* and first conduit 11*b* to communicate with each other with the result that the refrigerant flows through compressor 4, delivery tube 5, conduit 8, indoor heat exchanger 10, throttle 23, outdoor heat exchanger 9, conduit 7, suction tube 6, and compressor 4 to permit the system to perform the indoor heating operation.

In order to switch the indoor heating operation to the indoor cooling operation, electromagnetic pilot valve 16 is deenergized as shown in FIG. 14. As a result, plunger 17 is driven by compression spring 20 toward plug 3 to close bleeder hole 3*a* by means of ball valve 18 while said plunger 17 drives slider 24 by way of coupling pin 26 such that actuator pin 25 attached to said slider 24 pushes ball valve 12*c* away from valve seat 12*b* to open pressure equalizing hole 12*a*. This sequence of operation causes first and second chambers $R_1$ and $R_2$ to be brought under the equal pressure, thus permitting compression spring 13 to move piston 12 and slide valve 21 to the first position s shown in FIG. 12 such that indoor cooling operation is started.

The present invention is characterized in that the cylindrical valve body is divided into two chambers consisting of a high pressure chamber and pressure control chamber and that the piston is formed with a pressure equalizing hole while a compression spring is provided to urge the piston toward the high pressure chamber. Since no additional chamber is needed for the operation of the valve, it is now possible to make the whole structure compact and simple while stable operation is made possible as well as delicate electronic operation.

What is claimed is:

1. A reversible four-way valve for reversible refrigerating cycle comprising a cylindrical reversible valve body;

a single piston slidably provided within said cylindrical reversible valve body to divide the same into a first chamber and a second chamber, said first chamber being formed with a high pressure port communicating with a compressor delivery side, said single piston having an equalizing hole therein to render said first and second chambers in constant communication with each other and normally under a substantially equal pressure;

a valve seat formed within said first chamber to extend longitudinally, said valve seat being formed with a first outlet communicating with a first heat exchanger and second outlet communicating with a second heat exchanger, said valve seat being formed with a low pressure port between said first and second outlets for communicating with a compressor suction side;

a slide valve connected to said single piston and adapted to slide over said valve seat to communicate said low pressure port selectively with said first outlet and said second outlet;

resilient means having a force sufficient for urging said piston toward the first chamber when both chambers are under substantially equal pressure;

low pressure commmunication means for bringing said second chamber and said compressor suction side into communication with each other when it is operated from a normal position where it is closed, said low pressure communication means having a larger diameter than said pressure equalizing hole in the single piston; and pilot valve means for controlling said low pressure communication means by selectively closing and opening said low pressure communication means.

2. A reversible four-way valve according to claim 1, wherein said slide valve is of a polymeric material and includes a slide surface in contact with said valve seat, said slide surface being coated with a metal film, said valve seat being of a metallic material.

3. A reversible four-way valve according to claim 1, wherein said single piston is adapted to take a first position by virtue of said urging of the resilient means to bring said low pressure port and said second outlet into communication with each other and a second position by virtue of high pressure introduced into the first chamber from compressor delivery side to bringing said low pressure port and said first outlet into communication with each other.

4. A reversible four-way valve according to claim 3, further including means for blocking said pressure equalizing hole when the piston takes said second position.

5. A reversible four-way valve according to claim 4, wherein said blocking means includes a plug member provided at a longitudinal end of said cylindrical valve body to define said second chamber in cooperation therewith, said plug member having an inner wall in facing relation with said pressure equalizing hole.

6. A reversible four-way valve according to claim 5, further including a ball valve resiliently provided between said piston and said plug member, said ball valve being positioned to face the pressure equalizing hole.

7. A reversible four-way valve according to claim 6, said plug member being integrally formed with a needle valve pointing toward the pressure equalizing hole, and further including a resilient member between said piston and the plug member.

8. A reversible valve according to claim 4, wherein said blocking means includes a ball valve provided on the first chamber side of the piston and positioned to face said pressure equalizing hole; a plug member provided at a longitudinal end of said cylindrical valve body to define said second chamber in cooperation therewith, said plug member having said low pressure communication means in the form of bleeder holes, said plug member having a guide recess to face the second chamber; a slider received in said recess, said slider being adapted to actuated by control valve means; and an actuator pin attached to said slider to longitudinally extend within said second chamber and through the equalizing hole so as to stay within said pressure equalizing hole when the control means opens the bleeder holes but project out said pressure equalization hole to push the ball valve when the control means blocks the bleeder hole, said equalizing hole having a larger diametrical size than said actuator pin.

* * * * *